US007874808B2

(12) United States Patent
Stiles

(10) Patent No.: US 7,874,808 B2
(45) Date of Patent: Jan. 25, 2011

(54) VARIABLE SPEED PUMPING SYSTEM AND METHOD

(75) Inventor: Robert Stiles, Holly Springs, NC (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 304 days.

(21) Appl. No.: 10/926,513

(22) Filed: Aug. 26, 2004

(65) Prior Publication Data

US 2006/0045750 A1 Mar. 2, 2006

(51) Int. Cl.
*F04B 49/20* (2006.01)
*E04H 4/12* (2006.01)

(52) U.S. Cl. ..... 417/18; 417/20; 417/22; 417/42; 417/43; 417/44.2; 210/167.1; 210/167.12; 210/167.14; 4/490

(58) Field of Classification Search ..... 417/42, 417/18, 19, 20, 43, 44.2; 210/167.1, 167.2, 210/167.11, 167.12, 167.13, 167.14, 167.15, 210/167.16, 167.17, 167.18, 167.19, 85, 210/86, 87, 90; 4/490; 137/565.11
See application file for complete search history.

(56) References Cited

U.S. PATENT DOCUMENTS

| | | | | |
|---|---|---|---|---|
| 3,613,805 | A | 10/1971 | Linstad | |
| 3,778,804 | A * | 12/1973 | Adair | 340/544 |
| 3,787,882 | A | 1/1974 | Fillmore | |
| 4,353,220 | A | 10/1982 | Curwen | |
| 4,494,180 | A | 1/1985 | Streater | |
| 4,610,605 | A | 9/1986 | Hartley | |
| 4,678,409 | A | 7/1987 | Kurokawa | |
| 4,703,387 | A | 10/1987 | Miller | |
| 4,767,280 | A | 8/1988 | Markuson | |
| 4,795,314 | A | 1/1989 | Prybella et al. | |
| 4,834,624 | A | 5/1989 | Jensen et al. | |
| 4,912,936 | A | 4/1990 | Denpou | |
| 4,963,778 | A | 10/1990 | Jensen | |
| 5,026,256 | A | 6/1991 | Kuwabara et al. | |
| 5,099,181 | A | 3/1992 | Canon | |
| 5,117,233 | A * | 5/1992 | Hamos et al. | 340/825.69 |

(Continued)

FOREIGN PATENT DOCUMENTS

| | | |
|---|---|---|
| DE | 19645129 | 5/1998 |

(Continued)

OTHER PUBLICATIONS

Bibliographic Data Sheet—U.S. Appl. No. 10/730,747 Applicant: Robert M. Koehl Reasons for Inclusion: Printed publication US 2005/0123408 A1 for U.S. Appl. No. 10/730,747 has incorrect filing date.*

(Continued)

*Primary Examiner*—Devon C Kramer
*Assistant Examiner*—Leonard J Weinstein
(74) *Attorney, Agent, or Firm*—Greenberg Traurig, LLP

(57) ABSTRACT

A variable speed pumping system and an associated method for moving water of an aquatic application. The variable speed pumping system includes a water pump for moving water in connection with performance of an operation upon the water. A variable speed motor is operatively connected to drive the pump. A sensor senses a parameter of the operation performed upon the water. A controller controls speed of the motor in response to the sensed parameter of operation.

26 Claims, 3 Drawing Sheets

U.S. PATENT DOCUMENTS

| | | | | |
|---|---|---|---|---|
| 5,123,080 | A | 6/1992 | Gillett | |
| 5,156,535 | A | 10/1992 | Budris et al. | |
| 5,158,436 | A | 10/1992 | Jensen | |
| 5,167,041 | A | 12/1992 | Burkitt, III | |
| 5,240,380 | A | 8/1993 | Mabe | |
| 5,342,176 | A | 8/1994 | Redlich | |
| 5,471,125 | A | 11/1995 | Wu | |
| 5,512,883 | A | 4/1996 | Lane | |
| 5,518,371 | A | 5/1996 | Wellstein | |
| 5,519,848 | A | 5/1996 | Wloka | |
| 5,520,517 | A | 5/1996 | Sipin | |
| 5,571,000 | A | 11/1996 | Zimmermann | |
| 5,580,221 | A | 12/1996 | Triezenberg | |
| 5,598,080 | A | 1/1997 | Jensen | |
| 5,614,812 | A | 3/1997 | Wagoner | |
| 5,626,464 | A | 5/1997 | Schoenmyr | |
| 5,628,896 | A * | 5/1997 | Klingenberger | 210/86 |
| 5,711,483 | A | 1/1998 | Hays | |
| 5,727,933 | A | 3/1998 | Laskaris et al. | |
| 5,730,861 | A * | 3/1998 | Sterghos et al. | 210/86 |
| 5,791,882 | A | 8/1998 | Stucker | |
| 5,804,080 | A * | 9/1998 | Klingenberger | 210/739 |
| 5,819,848 | A | 10/1998 | Rasmusson | |
| 5,883,489 | A | 3/1999 | Konrad | |
| 5,909,372 | A | 6/1999 | Thybo | |
| 5,941,690 | A | 8/1999 | Lin | |
| 5,969,958 | A | 10/1999 | Nielsen | |
| 5,973,465 | A | 10/1999 | Rayner | |
| 6,037,742 | A | 3/2000 | Rasmussen | |
| 6,046,492 | A | 4/2000 | Machida | |
| 6,048,183 | A | 4/2000 | Meza | |
| 6,072,291 | A | 6/2000 | Pedersen | |
| 6,091,604 | A | 7/2000 | Plougsgaard | |
| 6,102,665 | A | 8/2000 | Centers | |
| 6,125,481 | A | 10/2000 | Sicilano | |
| 6,142,741 | A | 11/2000 | Nishihata | |
| 6,208,112 | B1 | 3/2001 | Jensen | |
| 6,254,353 | B1 | 7/2001 | Polo | |
| 6,264,431 | B1 | 7/2001 | Triezenberg | |
| 6,280,611 | B1 * | 8/2001 | Henkin et al. | 210/143 |
| 6,299,414 | B1 | 10/2001 | Schoenmyr | |
| 6,299,699 | B1 * | 10/2001 | Porat et al. | 134/6 |
| 6,326,752 | B1 | 12/2001 | Jensen | |
| 6,351,359 | B1 | 2/2002 | Jaeger | |
| 6,354,805 | B1 | 3/2002 | Moller | |
| 6,373,728 | B1 | 4/2002 | Aarestrup | |
| 6,380,707 | B1 | 4/2002 | Rosholm | |
| 6,406,265 | B1 | 6/2002 | Hahn | |
| 6,416,295 | B1 | 7/2002 | Nagai | |
| 6,426,633 | B1 | 7/2002 | Thybo | |
| 6,450,771 | B1 | 9/2002 | Centers | |
| 6,464,464 | B2 | 10/2002 | Sabini | |
| 6,468,042 | B2 | 10/2002 | Moller | |
| 6,468,052 | B2 | 10/2002 | McKain et al. | |
| 6,474,949 | B1 | 11/2002 | Arai | |
| 6,481,973 | B1 | 11/2002 | Struthers | |
| 6,483,378 | B2 | 11/2002 | Blodgett | |
| 6,548,976 | B2 | 4/2003 | Jensen | |
| 6,623,245 | B2 | 9/2003 | Meza | |
| 6,676,831 | B2 * | 1/2004 | Wolfe | 210/85 |
| 6,690,250 | B2 | 2/2004 | Moller | |
| 6,715,996 | B2 | 4/2004 | Moeller | |
| 6,717,318 | B1 | 4/2004 | Mathiassen | |
| 6,747,367 | B2 * | 6/2004 | Cline et al. | 307/11 |
| 6,774,664 | B2 | 8/2004 | Godbersen | |
| 6,925,823 | B2 | 8/2005 | Lifson | |
| 7,005,818 | B2 | 2/2006 | Jensen | |
| 7,050,278 | B2 | 5/2006 | Poulsen | |
| 7,083,392 | B2 | 8/2006 | Meza | |
| 7,221,121 | B2 | 5/2007 | Skaug | |
| 2001/0041139 | A1 | 11/2001 | Sabini et al. | |
| 2002/0050490 | A1 | 5/2002 | Pittman | |
| 2002/0070875 | A1 * | 6/2002 | Crumb | 340/825.69 |
| 2002/0136642 | A1 | 9/2002 | Moller | |
| 2003/0017055 | A1 | 1/2003 | Fong | |
| 2003/0034284 | A1 * | 2/2003 | Wolfe | 210/85 |
| 2003/0099548 | A1 | 5/2003 | Meza | |
| 2003/0196942 | A1 * | 10/2003 | Jones | 210/169 |
| 2004/0009075 | A1 | 1/2004 | Meza | |
| 2004/0013531 | A1 | 1/2004 | Curry et al. | |
| 2005/0123408 | A1 * | 6/2005 | Koehl | 417/53 |
| 2005/0170936 | A1 * | 8/2005 | Quinn | 482/55 |
| 2005/0190094 | A1 | 9/2005 | Andersen | |
| 2005/0226731 | A1 | 10/2005 | Mehlhorn | |
| 2006/0090255 | A1 | 5/2006 | Cohen | |
| 2006/0127227 | A1 | 6/2006 | Mehlhorn | |
| 2007/0114162 | A1 | 5/2007 | Stiles | |
| 2007/0154319 | A1 | 7/2007 | Stiles | |
| 2007/0154320 | A1 | 7/2007 | Stiles | |
| 2007/0154321 | A1 | 7/2007 | Stiles | |
| 2007/0154322 | A1 | 7/2007 | Stiles | |
| 2007/0154323 | A1 | 7/2007 | Stiles | |
| 2007/0163929 | A1 | 7/2007 | Stiles | |
| 2007/0183902 | A1 | 8/2007 | Stiles | |

FOREIGN PATENT DOCUMENTS

| | | |
|---|---|---|
| DE | 10231773 | 2/2004 |
| DE | 19938490 | 4/2005 |
| EP | 0314249 | 5/1989 |
| EP | 0709575 | 5/1996 |
| EP | 0735273 | 10/1996 |
| EP | 0978657 | 2/2000 |
| FR | 2529965 | 6/1983 |
| FR | 2703409 | 10/1994 |
| JP | 5010270 | 1/1993 |
| WO | WO 98/04835 | 2/1998 |
| WO | WO 01/47099 | 6/2001 |
| WO | WO 2004/006416 | 1/2004 |
| WO | WO 2004/088694 | 10/2004 |
| WO | WO 2006/069568 | 7/2006 |

OTHER PUBLICATIONS

"Better, Stronger, Faster;" Pool & Spa News, Sep. 3, 2004; pp. 52-54, 82-84, USA.

* cited by examiner

VARIABLE SPEED PUMPING SYSTEM AND METHOD

FIELD OF THE INVENTION

The present invention relates generally to pumps, and more particularly to variable speed pumping systems for pools and other aquatic applications that are operable in response to a sensed condition and/or a user input instruction.

BACKGROUND OF THE INVENTION

Conventionally, a pump to be used in an aquatic application such as a pool or a spa is operable at a finite number of predetermined speed settings (e.g., typically high and low settings). Typically these speed settings, correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pumping demands.

Installation of the pump for an aquatic application such as a pool entails sizing the pump to meet the pumping demands of that particular pool and any associated features. Because of the large variety of shapes and dimensions of pools that are available, precise hydraulic calculations must be performed by the installer, often on-site, to ensure that the pumping system works properly after installation. The hydraulic calculations must be performed based on the specific characteristics and features of the particular pool, and may include assumptions to simplify the calculations for a pool with a unique shape or feature. These assumptions can introduce a degree of error to the calculations that could result in the installation of an unsuitably sized pump. Essentially, the installer is required to install a customized pump system for each aquatic application.

A plurality of aquatic applications at one location requires a pump to elevate the pressure of water used in each application. When one aquatic application is installed subsequent to a first aquatic application, a second pump must be installed if the initially installed pump cannot be operated at a speed to accommodate both aquatic applications. Similarly, features added to an aquatic application that use water at a rate that exceeds the pumping capacity of an existing pump will need an additional pump to satisfy the demand for water. As an alternative, the initially installed pump can be replaced with a new pump that can accommodate the combined demands of the aquatic applications and features.

During use, it is possible that a conventional pump is manually adjusted to operate at one of the finite speed settings. Resistance to the flow of water at an intake of the pump causes a decrease in the volumetric pumping rate if the pump speed is not increased to overcome this resistance. Further, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Accordingly, it would be beneficial to provide a pump that could be readily and easily adapted to provide a suitably supply of water at a desired pressure to aquatic applications having a variety of sizes and features. The pump should be customizable on-site to meet the needs of the particular aquatic application and associated features, capable of pumping water to a plurality of aquatic applications and features, and should be variably adjustable over a range of operating speeds to pump the water as needed when conditions change. Further, the pump should be responsive to a change of conditions and/or user input instructions.

SUMMARY OF THE INVENTION

In accordance with one aspect, the present invention provides a variable speed pumping system for moving water of an aquatic application. The variable speed pumping system includes a water pump for moving water in connection with performance of an operation upon the water. A variable speed motor is operatively connected to drive the pump. A sensor for senses a parameter of the operation performed upon the water. A controller controls speed of the motor in response to the sensed parameter of operation.

In accordance with another aspect, the present invention provides a method of operating a variable speed pumping system for moving water of an aquatic application. A water pump is driven for moving water in connection with performance of an operation upon the water. A variable speed motor connected and operated to drive the pump. A parameter of the operation performed upon the water is sensed. The speed of the motor is controlled in response to the sensed parameter of operation.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
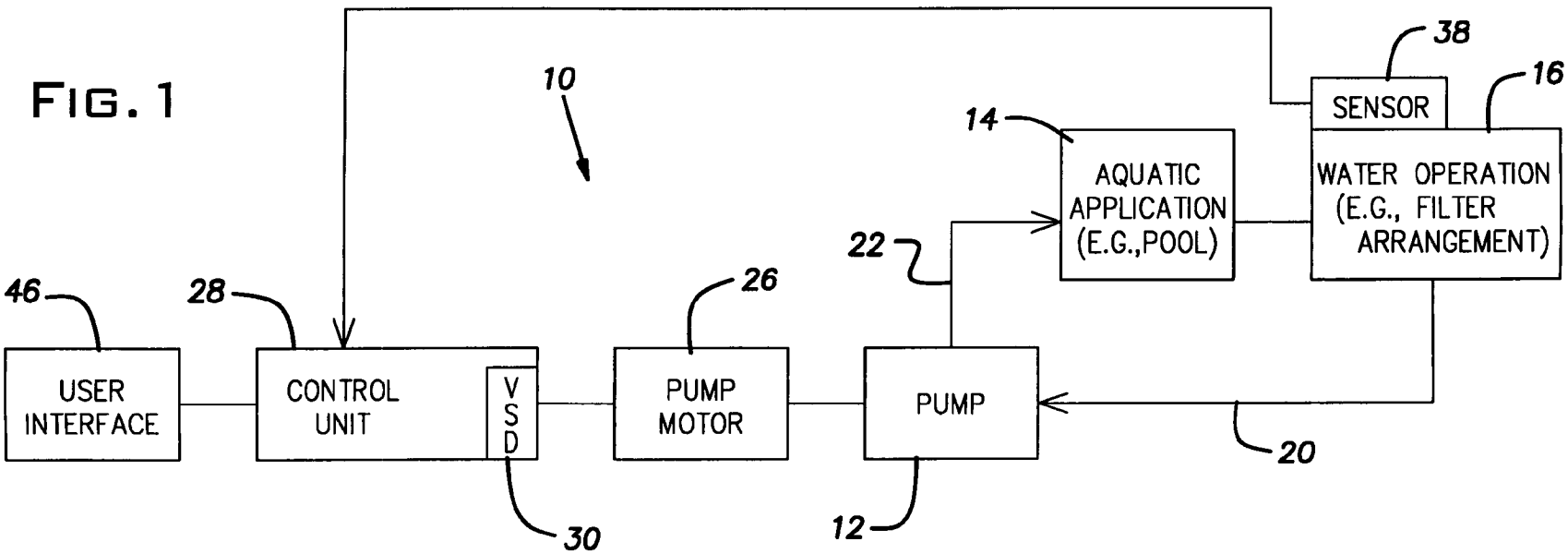
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with the present invention is schematically shown in FIG. 1. The pumping system 10 includes a pump 12 that is shown as being used with a pool 14 environment. The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention.

Herein, the terms pool and water are used with the understanding that they are not limitations on the present invention.

Within the shown example, a filter arrangement 16 is associated with the pumping system 10 and the pool 14 for providing a cleaning operation (i.e., filtering) on the water within the pool. The filter arrangement 16 is operatively connected between the pool 14 and the pump 12 at/along an inlet line 20 for the pump. It is to be appreciated that the function of filtering is but one example of an operation that can be performed upon the water. Other operations that can be performed upon the water may be simplistic, complex or diverse. For example, the operation performed on the water may merely be just movement of the water by the pumping system 10 (e.g., re-circulation of the water in a waterfall or spa environment).

Turning to the filter arrangement 16, any suitable construction and configuration of the filter arrangement is possible. For example, the filter arrangement 16 may include a skimmer assembly for collecting coarse debris from water being withdrawn from the pool 14, and one or more filter components for straining finer material from the water.

The pump 12 may have any suitable construction and/or configuration for providing the desired force to the water and move the water. In one example, the pump 12 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. A return line 22 directs the return flow of water to the pool. Although centrifugal pumps are well suited to pump a large volume of water at a continuous rate, other motor-operated pumps may also be used within the scope of the present invention.

Drive force is provided to the pump via a pump motor 26. In the one example, the drive force is in the form of rotational force provided to rotate the impeller of the pump 12. In one specific embodiment, the pump motor 26 is a permanent magnet motor. In another specific embodiment, the pump motor 26 is a three-phase motor. The pump motor 26 operation is infinitely variable within a range of operation (i.e., zero to maximum operation). In one specific example, the operation is indicated by the RPM of the rotational force provided to rotate the impeller of the pump 12.

A control unit 28 provides for the control of the pump motor 26 and thus the control of the pump 12. Within the shown example, the control unit 28 includes a variable speed drive 30 that provides for the infinitely variable control of the pump motor 26 (i.e., varies the speed of the pump motor). By way of example, within the operation of the variable speed drive 30 a single phase AC current from a source power supply is converted (e.g., broken) into a three-phase DC current. Any suitable technique and associated construction/configuration may be used to provide the three-phase DC current may be used. For example, the construction may include capacitors to correct line supply over or under voltages. The variable speed drive 30 supplies the DC electric power at a changeable frequency to the pump motor 26 to drive the pump motor. The construction and/or configuration of the pump 12, the pump motor 26, the control unit 28, as a whole, and the variable speed drive 30, as a portion of the control unit, are not limitations on the present invention. In one possibility, these components are disposed within a single housing to form a single unit.

A sensor 34 of the pumping system 10 senses a parameter indicative of the operation performed upon the water. In the shown example, the sensor 34 is operatively connected with the filter arrangement 16 and senses an operation characteristic associated with the filter arrangement. For example, the sensor 34 may monitor filter performance. Such monitoring may be as basic as monitoring flow rate, pressure, or some other parameter that indicates performance. Of course, it is to be appreciated that the sensed parameter of operation may be otherwise associated with the operation performed upon the water. As such, the sensed parameter of operation can be as simplistic as a flow indicative parameter such as rate, pressure, etc. The sensor 34 is also operatively connected to the control unit 28 to provide the sensory indication thereto.

It is to be appreciated that the sensor can be otherwise connected and other wise operated. For example, the sensor 34 may sense a parameter, such as flow rate or pressure, which is indicative of the pump moving the water but is also indicative of the lack of the water movement. Such an indication can be used within the program as an indication of an obstruction (e.g., by a person or large debris object). Such indication information can be used by the program to perform various functions, and examples of such are set forth below. Also, it is to be appreciated that additional functions and features may be separate or combined, and that sensor information may be obtained by one or more sensors. The example concerning obstruction can be considered to be an example operation upon the water. Further, the example can be considered to be an example of an abnormal operation on the water (i.e., no water movement).

With regard to the specific example of monitoring operation performance of the filter arrangement 16, the signal from the sensor 34 can indicate impediment or hindrance can be any obstruction or condition, whether physical, chemical, or mechanical in nature, that interferes with the flow of water from the aquatic application to the pump 12 such as debris accumulation or the lack of accumulation, within the filter arrangement 16.

Turning back to the shown example, the sensor 34 is of a kind to detect any one or more conditions indicative of the volume, rate, mass, pressure, or any other condition of water being moved through the filter arrangement 16 to the pump via the inlet line 20. Also, the condition may be associated with the operation, effectiveness, etc. of the filter operation. By monitoring such condition(s), operation performance can be determined. It is to be noted that in the shown example, the sensor 34 is shown in connection with the filter arrangement 16. However, it is to be appreciated that the sensor 34 can be located at other points along the flow path. Also, the shown example has only a single sensor. It is to be appreciated that multiple sensors are possible.

As indicated above, the speed of operation of the pump 12 is determined in response to a sensed operation parameter. In one example, the operation is based upon an approach in which the pump is controlled to operate at a lowest amount that will accomplish the desired task (e.g., maintain a desired filtering level of operation). Specifically, as the sensed parameter changes, the lowest level of pump operation (i.e., pump speed) to accomplish the desired task will need to change. The control unit 28 provides the control to operate the pump motor/pump accordingly. In other words, the control unit 28 repeatedly adjusts the speed of the pump motor 26 to a minimum level responsive to the sensed parameter to maintain the sensed parameter of operation at a level. Such an operation mode can provide for minimal energy usage.

Focusing on the aspect of minimal energy usage, within some know pool filtering applications, it is common to operate a known pump/filter arrangement for some portion (e.g., eight hours) of a day at effectively a very high speed to accomplish a desired level of pool cleaning. With the present invention, the pumping system 10 with the associated filter arrangement 16 can be operated continuously (e.g., 24 hours a day) at an ever-changing minimum level to accomplish the desired level of pool cleaning. It is possible to achieve a very significant savings in energy usage with such a use of the present invention as compared to the known pump operation at the high speed. In one example, the cost savings would be in the range of 90% as compared to a known pump/filter arrangement.

Aquatic applications will have a variety of different water demands depending upon the specific attributes of each aquatic application. Turning back to the aspect of the pump that is driven by the infinitely variable motor, it should be appreciated that precise sizing, adjustment, etc. for each application of the pump system for an aquatic application can thus be avoided. In many respects, the pump system is self adjusting to each application.

It is to be appreciated that the control unit 28 may have various forms to accomplish the desired functions. In one example, the control unit 28 includes a computer processor that operates a program. In the alternative, the program may be considered to be an algorithm. The program may be in the form of macros. Further, the program may be changeable, and the control unit 28 is thus programable.

Figure 2:
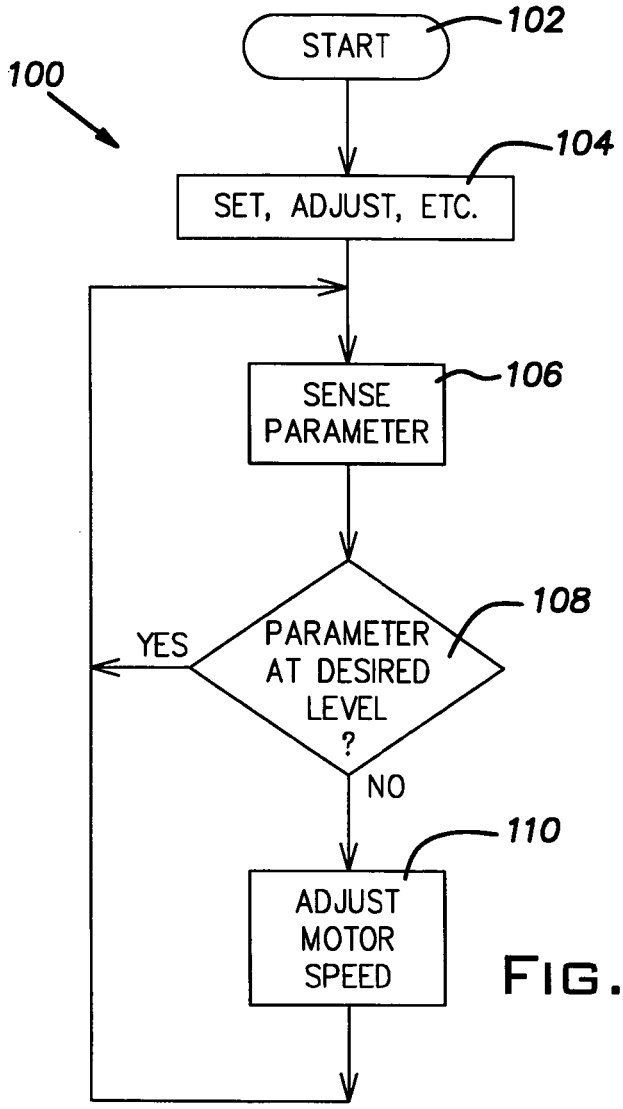
FIG. 2 is a top-level flow chart for an example method in accordance with the present invention.

In one method of control, testing can be done to determine a lowest point of operation that provides the desired response. Such a lowest point of operation is then set as a minimum (e.g., a floor). As the pumping system 10 is operated, the sensed parameter is monitored to determine a needed change in pump speed. As the parameter changes the speed of the pump 12 is changed. In one specific example, the minimum (e.g., floor) speed is continuously changed in response to the sensed parameter. FIG. 2 is a top-level flow chart that shows an example method 100 of operation. The method 100 is initiated at step 102 and proceeds to step 104, wherein various initial values are set, adjusted, etc. At step 106, the parameter is sensed. At step 108, a determination is made as to whether the parameter is a desired level. If the determination is affirmative (i.e., the parameter is at the desired level), the method returns to sense the parameter again at step 106. However, if the determination at step 108 is negative (i.e., the parameter is not at the desired level), the motor speed is adjusted accordingly at step 110. The method 100 then proceeds to sense the parameter again at step 106. It is to be appreciated that the parameter may indicate sufficient level of filtering, insufficient level of filtering, or excessive level of filter, and the motor is adjusted accordingly. Also, it is to be appreciated that various change amounts, change delays, etc. may be incorporated into the method.

Turning to the aspect that other, different, and/or additional functions can be performed by the system 10 in accordance with the present invention. As mentioned above, the sensory input can be used to determine an obstruction. Various functions can be accomplished in response to such sensory information. In one example, the program can control the motor to cease operation until the obstruction is removed. This will help prevent unnecessary strain on the motor and/or pump and can help prevent entrapment.

Some example of other functions that can be provided, either alone or in combination with one or more other functions, include using sensory information to determine heater operation and loss of pump prime. Turning to heater operation, it is to be appreciated that the pool, other aquatic application, may include a heater that provides heat to the water being moved such that returned water is warmer. It is possible that the heat requires a minimum threshold of water movement for proper operation. As such, a sensor, which could merely be a signal input from the heater, could be utilized to provide an indication of operation of heater applying heat to the water. During such heater operation, the program can operate the motor/pump in a different desired manner. For example, the motor/pump may be operated to increase (e.g., ramp-up) the flow rate to ensure that at least a predetermined amount of water flows by the heater to absorb the heat being proved by the heater. Such an operation may help prevent damage to the heater. With regard to the loss of prime at the pump, sensory information concerning an event can be obtained and utilized. Obtaining an indication of loss of prime may be by any sensory means, including but not limited to sensed lack of flow. The program can utilize the information to cease operation of the motor/pump. Such an operation may help prevent damage to the motor/pump. These examples can be considered to be examples of pump system components performing operations on the water. Also, the example concerning loss of prime can be considered to be an example of an abnormal operation on the water (i.e., no water movement).

Focusing upon the controllability of the pump operation, it is to be appreciated that the control unit 28 may include a memory (not shown) to store information that correlates sensed data and/or user input data with speed data of the pump 12. In order to provide user input, the shown example pumping system includes a user interface 46 having means 48 (FIG. 3) for inputting a desired operation of the pumping system 10 is provided within the example system. The interface 46 also provides a means 50 to receive indication information from the control unit 28. Within the shown example, input is provided via selectors 48 for input of desired operation for the motor/pump, and a display portion 50 provides information pertaining to the operation of the pumping system 10.

It is to be appreciated that the pump motor 26 (FIG. 1) may be operated within other modes. Some of the modes may be based upon input from the sensor and some of the modes may be based upon other criteria or input. In one example, the operation may be based upon input provided via the user interface 46. One specific example of a mode that can be entered via use of the user interface is operation of the pump 12 at an increased level when it is desired to utilize an accessory cleaning implement within the pool 14. Also, the pumping system 10 can be placed into an idle mode (e.g., when the pool 14 is being otherwise serviced) or a completely off mode to conserve electric power.

Figure 3:
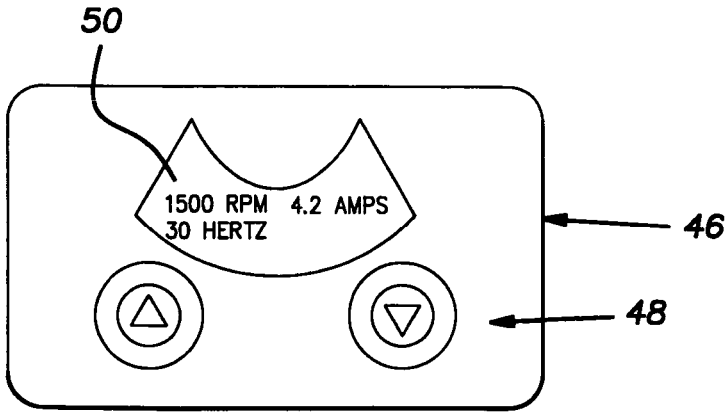
FIG. 3 is an illustration of a user interface for one example of the pumping system of FIG. 1.
Figure 4:
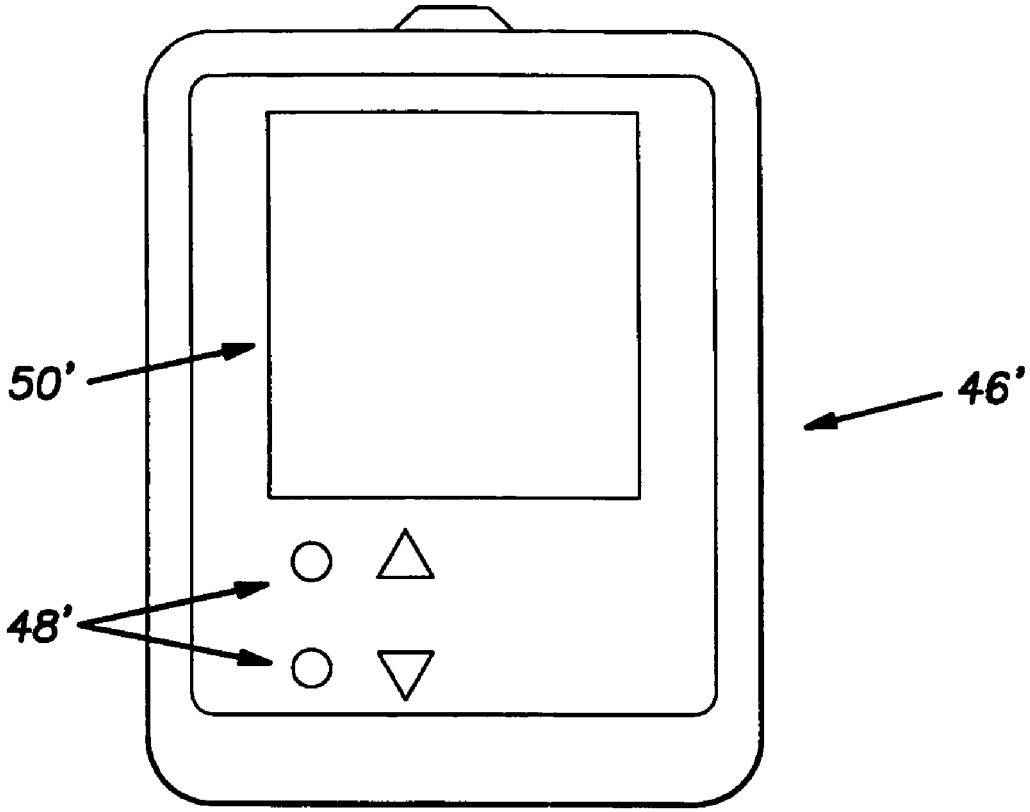
FIG. 4 is an illustration of a user interface for another example of the pumping system of FIG. 1.

As shown in FIG. 4, a remote user interface 46' can be used with, or in place of the user interface 46 shown in FIG. 3. The remote user interface 46' communicates with the control unit 28 via a radio signal, IR beam, or the like.

Turning to an aspect of control, it is to be appreciated that the pumping system 10, and in particular the program performed within the control unit 28 is operatable as a freestanding or autonomous system, as shown in the presented example. However, it is to be appreciated that the pumping system 10, and in particular the program, may be operated as a part of an overall arrangement. For example, an automation controller may be used to control the program, and thus the pumping system 10, along with other systems, devices, aspects, etc. associated the pool or aquatic application. In one embodiment, the pumping system 10, and the program performed therein, is controlled as a slave to the master of the automation controller. It is to be appreciated that suitable communication interconnections are proved within such an overall arrangement.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

What is claimed:

1. A pumping system for at least one aquatic application including a pool, the pumping system controlled by a user, the pumping system adapted to be coupled to a pool filter and a pool vacuum, the pumping system comprising:

a pump;

a variable speed motor coupled to the pump;

a user interface that receives an input including a desired filtering level of operation from the user including a mode for operation of the pump at an increased level during use of the pool vacuum; and a controller in electrical communication with the variable speed motor and the user interface, the controller determining a current value of at least one of a volume, a flow rate, a mass, and a pressure in the pumping system associated with the desired filtering level of operation, the controller substantially continuously modifying an actual speed of the variable speed motor based on the current value in order to operate the variable speed motor at a substantially minimum speed to achieve the desired filtering level of operation with substantially minimal energy usage;

a subsequent aquatic application being added to the pumping system and wherein the controller self-adjusts the actual speed of the variable speed motor to operate at a new minimum speed to achieve the desired filtering level of operation with substantially minimal energy usage.

2. The pumping system of claim 1, wherein the controller increases flow during operation of the pool vacuum.

3. The pumping system of claim 1, wherein the controller enters an idle mode while the pumping system is being serviced.

4. The pumping system of claim 1, wherein the controller determines that the pump has lost prime.

5. The pumping system of claim 1, wherein the controller determines that there is an obstruction in the pumping system and automatically stops flow.

6. The pumping system of claim 1, and further comprising at least one sensor to sense at least one of volume, flow rate, mass, and pressure, the at least one sensor being in communication with the controller.

7. The pumping system of claim 1, wherein the user interface includes a plurality of selectors.

8. The pumping system of claim 1, wherein the user interface includes a display.

9. The pumping system of claim 1, wherein the user interface includes a remote user interface.

10. The pumping system of claim 9, wherein the controller is coupled to the remote user interface through a wireless connection.

11. The pumping system of claim 10, wherein the wireless connection includes at least one of a radio signal connection and an infrared beam connection.

12. The pumping system of claim 1, and further comprising a single housing encasing the pump, the variable speed motor, the user interface, and the controller.

13. The pumping system of claim 1, wherein the variable speed motor includes a permanent magnet motor.

14. The pumping system of claim 1, wherein the variable speed motor includes a three-phase motor.

15. The pumping system of claim 1, and further comprising an interface with a master controller for receiving the desired filtering level of operation.

16. The pumping system of claim 1, wherein the subsequent aquatic application includes at least one of a spa, a whirlpool bath, a pond, a water jet, a water fall, a fountain, a reservoir, a tank, a container, and a heater.

17. A method of operating a pumping system for an aquatic application including a pool, the pumping system adapted to be coupled to a pool filter and a pool vacuum, the method comprising:

operating the pool filter which is capable of filtering impurities from substantially all of the water in the pool;

operating the pool vacuum;

receiving an input from a user interface during operation of the pumping system, the input including a desired filtering level of operation including a mode for operation of the pump at an increased level during use of the pool vacuum;

determining a current value of at least one of a volume, a flow rate, a mass, and a pressure of the pumping system associated with the desired filtering level of operation;

substantially continuously modifying an actual speed of a variable speed motor coupled to the pump based on the current value and the desired filtering level of operation in order to operate the variable speed motor at a substantially minimum speed to achieve the desired filtering level of operation with substantially minimal energy usage;

adding a subsequent aquatic application to the pumping system and self-adjusting the actual speed of the variable speed motor to operate at a new minimum speed to achieve the desired filtering level of operation with substantially minimal energy usage.

18. The method of claim 17, and further comprising increasing flow during operation of the pool vacuum.

19. The method of claim 17, and further comprising placing the pumping system in an idle mode while the pumping system is being serviced.

20. The method of claim 17, and further comprising determining that the pump has lost prime.

21. The method of claim 17, and further comprising determining that there is an obstruction in the pumping system and automatically stopping flow.

22. The method of claim 17, and further comprising sensing at least one of volume, flow rate, mass, and pressure.

23. The method of claim 17, wherein receiving an input from a user interface includes receiving an input from a remote user interface.

24. The method of claim 23, wherein receiving an input from a remote user interface includes receiving an input from a remote user interface via at least one of a radio signal connection and an infrared beam connection.

25. The method of claim 17, and further comprising receiving the desired filtering level of operation from an interface with a master controller.

26. The pumping system of claim 1, wherein the subsequent aquatic application includes at least one of a spa, a whirlpool bath, a pond, a water jet, a water fall, a fountain, a reservoir, a tank, a container, and a heater.

* * * * *